US007809306B2

(12) United States Patent
Itabashi

(10) Patent No.: US 7,809,306 B2
(45) Date of Patent: Oct. 5, 2010

(54) PROCESS CARTRIDGE

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 71 days.

(21) Appl. No.: 12/341,065

(22) Filed: Dec. 22, 2008

(65) Prior Publication Data

US 2009/0169250 A1 Jul. 2, 2009

(30) Foreign Application Priority Data

Dec. 28, 2007 (JP) ..... 2007-338581

(51) Int. Cl.
*G03G 15/02* (2006.01)

(52) U.S. Cl. ..... 399/100; 399/111; 399/170; 399/171

(58) Field of Classification Search ..... 399/98–100, 399/107, 111, 115, 168, 170–172
See application file for complete search history.

(56) References Cited

U.S. PATENT DOCUMENTS

| | | | | |
|---|---|---|---|---|
| 6,385,414 | B1 * | 5/2002 | Sato et al. | 399/98 |
| 7,356,286 | B2 * | 4/2008 | Itabashi et al. | 399/170 |
| 2003/0039485 | A1 | 2/2003 | Yoshiyama | |
| 2006/0018683 | A1 | 1/2006 | Itabashi | |
| 2006/0153594 | A1 | 7/2006 | Yoshiyama | |
| 2007/0025755 | A1 * | 2/2007 | Ishikawa et al. | 399/98 |
| 2007/0280731 | A1 * | 12/2007 | Deguchi | 399/111 |
| 2008/0253806 | A1 * | 10/2008 | Yoshino et al. | 399/171 |

FOREIGN PATENT DOCUMENTS

| | | | |
|---|---|---|---|
| JP | 58-023339 | | 2/1983 |
| JP | 59-051352 | | 4/1984 |
| JP | 02-034874 | | 2/1990 |
| JP | 05-323769 | | 12/1993 |
| JP | 08-030072 | | 2/1996 |
| JP | 8-030072 | A | 2/1996 |
| JP | 2000-122374 | A | 4/2000 |
| JP | 2003-140438 | A | 5/2003 |
| JP | 2005-134648 | A | 5/2005 |
| JP | 2006-039139 | | 2/2006 |
| JP | 2006-317820 | A | 11/2006 |

OTHER PUBLICATIONS

JP Office Action dtd Feb. 2, 2010, JP Appln. 2007-338581, partial English translation.
JP Office Action dtd Apr. 27, 2010, JP Appln. 2007-338591, English Translation.

* cited by examiner

*Primary Examiner*—Hoan Tran
(74) *Attorney, Agent, or Firm*—Banner & Witcoff, Ltd.

(57) ABSTRACT

A process cartridge includes a photosensitive member, a charger, a frame and a block member. The charger charges the photosensitive member and includes a charging wire and a grid electrode, which is provided between the charging wire and the photosensitive member, and which has an opening area in a surface opposing the photosensitive member. The frame supports the photosensitive member and the charger. The block member is provided between the charging wire and an end portion of the grid electrode in a longitudinal direction thereof and prevents a marginal area of the grid electrode from facing the charging wire in a direction with a minimum distance therebetween, the marginal area being defined between an end of the grid electrode and an end of the opening area.

10 Claims, 7 Drawing Sheets

140
141
142
143
111
112
130
52B
110
130A
136C
122
120
136A
137
127A
127
123
136B
124
128
121
121A
IV
54
129
121B
RIGHT
LEFT

PROCESS CARTRIDGE

CROSS-REFERENCE TO RELATED APPLICATIONS

This application claims priority from Japanese Patent Application No. 2007-338581 filed on Dec. 28, 2007, the entire subject matter of which is incorporated herein by reference.

TECHNICAL FIELD

Aspects of the present invention relate to a process cartridge for an image forming apparatus.

BACKGROUND

In an image forming apparatus that forms an image electrophotographically, developer is supplied to a charged photosensitive member so as to form a developer image, and the developer image is transferred and fixed to a recording sheet. In such an image forming apparatus, a charger using a corona discharge is often used for charging the photosensitive member.

JP-A-2006-039139 discloses a related charger using a corona discharge. The related charger has a charging wire and a grid electrode. The charging wire is supplied with a voltage that is higher than that applied to the grid electrode. The grid electrode has a metal plate on which an opening area having a plurality of slit-shaped openings is formed. A charged air is flown from the charging wire toward the grid electrode through the opening area.

SUMMARY

Illustrative aspects of the invention provide a charger that is used in a process cartridge of an image forming apparatus and can uniformly generate a corona discharge for use in forming an image.

BRIEF DESCRIPTION OF THE DRAWINGS

FIGS. 4A and 4B show a drum upper frame of the image forming apparatus, in which FIG. 4A is an exploded perspective view of the drum upper frame, and FIG. 4B is a perspective cross-sectional view of the drum upper frame taken along a line IV-IV in FIG. 4A;

FIGS. 6A to 6C are cross-sectional views of the drum upper frame, in which FIG. 6A is a cross-sectional view taken along a line P-P in FIG. 5, FIG. 6B is a cross-sectional view taken along a line Q-Q in FIG. 5, and FIG. 6C is a cross-sectional view taken along a line R-R in FIG. 5; and FIGS. 7A and 7B are cross-sectional views of the drum upper frame, in which FIG. 7A is a cross-sectional view taken along a line S-S in FIG. 5, and FIG. 7B is a cross-sectional view taken along a line T-T in FIG. 5.

DETAILED DESCRIPTION

<General Overview>

In the related charger, electric flux lines oriented from the charging wire toward the grid electrode are attracted to edge portions of the grid electrode. For this reason, the electric flux lines are attracted to marginal areas at both ends of the grid electrode in a width direction thereof (i.e., a direction in which the charging wire is tensioned) in the opening area. Distribution of an electric discharge in the vicinity of the marginal areas may become non-uniform compared with the distribution of an electric discharge in a center of the opening area.

Illustrative aspects of the invention provide a charger that is used in a process cartridge of an image forming apparatus and can uniformly generate a corona discharge for use in forming an image.

According to illustrative aspects of the invention, there is provided a process cartridge comprising: a photosensitive member; a charger, which charges the photosensitive member, and which comprises: a charging wire; and a grid electrode, which is provided between the charging wire and the photosensitive member, and which has an opening area in a surface opposing the photosensitive member; a frame that supports the photosensitive member and the charger; and a block member, which is provided between the charging wire and an end portion of the grid electrode in a longitudinal direction thereof, and which prevents a marginal area of the grid electrode from facing the charging wire in a direction with a minimum distance therebetween, the marginal area being defined between an end of the grid electrode and an end of the opening area.

Exemplary Embodiments

Exemplary embodiments of the invention will now be described with reference to the drawings.

(Image Forming Apparatus)

In the descriptions that follow, directions as used herein refer to directions indicated by the arrows as indicated in each figure. Incidentally, in FIG. 1, a right-left direction and a width direction of a sheet P are equivalent. The directions are described with reference to directions of the user who uses an image forming apparatus.

Figure 1:
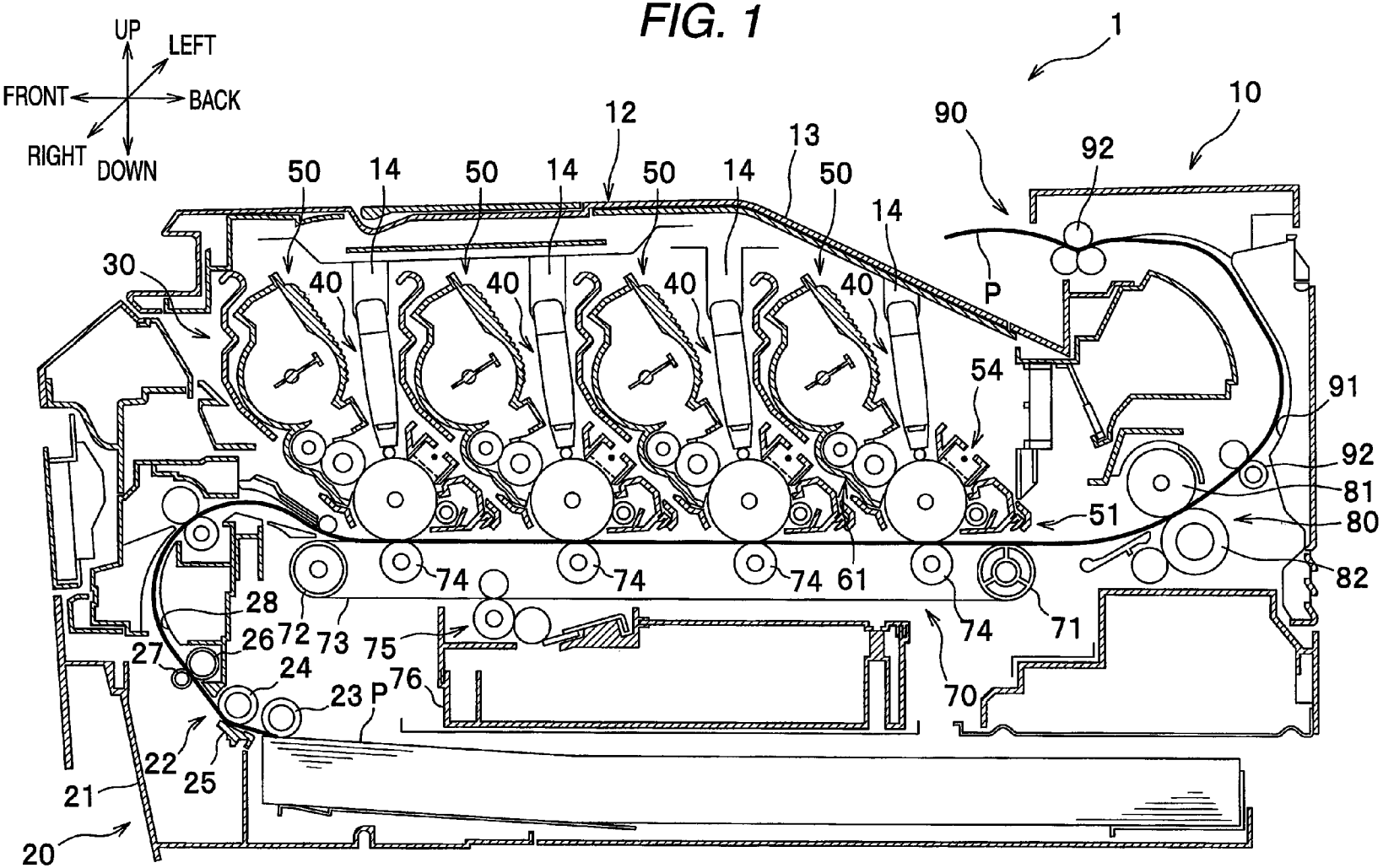
FIG. 1 is a cross-sectional view showing an image forming apparatus according to an exemplary embodiment of the invention.

As shown in FIG. 1, an image forming apparatus 1 includes, within a main housing 10, a sheet feeding section 20 for feeding the sheet P, an image forming section 30 for forming an image on the fed sheet P, and a sheet discharging section 90 for ejecting the sheet P with the image formed thereon. A color printer is one example of the image forming apparatus 1.

An upper cover 12 is provided in an upper portion of the main housing 10 so as to be able to vertically pivot around a hinge (not shown) provided in a rear side of the cover. An upper surface of the upper cover 12 acts as a sheet discharging tray 13 for accumulating the sheets P ejected from the main housing 10. A plurality of hold members 14 for holding LED units 40 (which will be described later) are provided on a lower surface of the upper cover 12.

The sheet feeding section 20 includes a sheet feeding tray 21 and a sheet feed mechanism 22. The sheet feeding tray 21 is disposed at a lower part in the main housing 10 and is removably attached to the main housing 10. The sheet feed mechanism 22 conveys the sheet P fed from the sheet feeding tray 21 to an image forming section 30. The sheet feed mechanism 22 includes a sheet feed roller 23, a separation roller 24, and a separation pad 25 which are disposed ahead of the sheet feeding tray 21.

In the sheet feeding section 20, the sheets P loaded in the sheet feeding tray 21 are separated one at a time, and the separated sheet is fed upwardly. During the course of the sheet passing between a paper dust removal roller 26 and a pinch roller 27, paper dust is removed from the sheet, and the direction of the sheet is turned backward by passing through a conveyance path 28. The turned sheet is fed to the image forming section 30.

The image forming section 30 includes four LED units 40, four process cartridges 50, a transfer unit 70 and a fixing unit 80.

Figure 2:
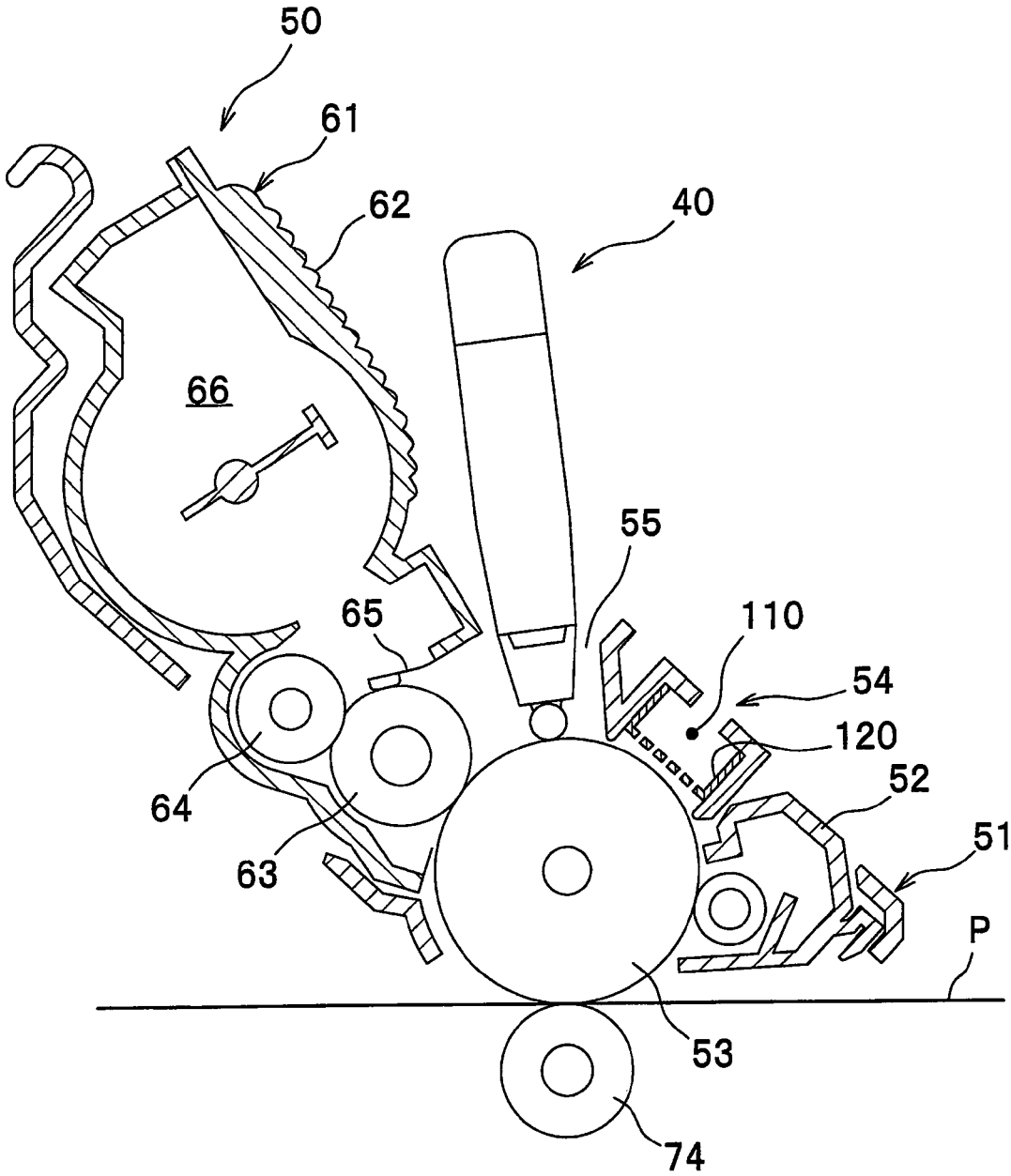
FIG. 2 is an enlarged cross-sectional view of a process cartridge of the image forming apparatus.

The process cartridges 50 are arranged in a longitudinal line between the upper cover 12 and the sheet feeding section 20. As shown in FIG. 2, each of the process cartridges 50 has a drum unit 51 and a development unit 61 that is removably attached to the drum unit 51. The process cartridge 50 supports a photosensitive drum 53. The process cartridges 50 differ from each other in terms of the color of developer accommodated in a developer storage chamber 66 of the development unit 61, whereas the structures of the process cartridges 50 are identical with each other.

The drum unit 51 has a drum frame 52, a photosensitive drum 53 rotatably supported by the drum frame 52, and a charger 54 supported by the drum frame 52. The drum frame 52 functions as an example of a frame. The photosensitive drum 53 functions as an example of a photosensitive member.

The drum frame 52 is configured such that, when the development unit 61 is attached to the frame, an exposure hole 55 through which the photosensitive drum 53 is viewed from an outside thereof is formed in the drum frame 52. As shown in FIG. 2, the LED unit 40 is inserted into the exposure hole 55 so as to oppose an upper surface of the photosensitive drum 53.

Each development unit 61 includes a development frame 62, a developing roller 63 and a supply roller 64 which are rotatably supported by the development frame 62, a layer thickness regulation blade 65, and the developer storage chamber 66 that accommodates developer.

As shown in FIG. 1, a transfer unit 70 is provided between the sheet feeding section 20 and the respective process cartridges 50. with the transfer unit 70 includes a drive roller 71, a driven roller 72, a conveyance belt 73, a transfer roller 74, and a cleaning section 75.

The drive roller 71 and the driven roller 72 are spaced away and in parallel with each other in the longitudinal direction. The conveyance belt 73 formed from an endless belt is stretched between the drive roller 71 and the driven roller 72. An exterior surface of the conveyance belt 73 is in contact with the respective photosensitive drums 53. Four transfer rollers 74 are provided inside of the conveyance belt 73 so as to oppose the respective photosensitive drums 53 while the conveyance belt 73 is sandwiched between the respective photosensitive drums 53 and the transfer rollers 74. At the time of transfer operation, a transfer bias is applied to the transfer roller 74 by means of constant current control.

The cleaning section 75 is disposed below the conveyance belt 73. The cleaning section 75 is configured so as to remove the developer adhering to the conveyance belt 73 and drop the removed developer into a developer accumulation section 76 disposed below the cleaning section.

The fixing unit 80 is disposed rearward of the respective process cartridges 50 and the transfer unit 70. The fixing unit 80 includes a heating roller 81 and a pressing roller 82 disposed opposite the heating roller 81 so as to press the heating roller 81.

In the image forming section 30, surfaces of the respective photosensitive drums 53 are uniformly charged by the charger 54 and exposed to light emitted from the respective LED units 40. Accordingly thereto, electric potentials of the exposed portions are reduced, and an electrostatic latent image based on image data is formed on each of the photosensitive drums 53.

The developer is supplied from the developer storage chambers 66 to the development rollers 63 by rotation of the supply rollers 64. The developer is then supplied between the respective development rollers 63 and the respective layer thickness regulation blades 65 by means of rotation of the respective development rollers 62. Thereafter, the developer is carried on the respective development rollers 62 as a thin layer having a thickness.

When the development rollers 63 face and contact the photosensitive drums 53, the developer carried on the respective development rollers 63 are supplied to the electrostatic latent images formed on the respective photosensitive drums 53. The developer is selectively carried on the respective photosensitive drums 53, to visualize the electrostatic latent images. The developer image is formed by means of a reversal development.

The sheet P fed onto the conveyance belt 73 passes between the respective photosensitive drums 53 and the respective transfer rollers 74 disposed inside of the conveyance belt 73, and the developer images formed on the respective photosensitive drums 53 are transferred onto the sheet P. When the sheet P passes between the heating roller 81 and the pressing roller 82, the developer images transferred on the sheet P are thermally fixed.

The sheet discharging section 90 includes a sheet-discharging-side conveyance path 91 and a plurality of conveyor roller pairs 92 for conveying the sheet P. The sheet-discharging-side conveyance path 91 extends upwardly from an exit of the fixing unit 80 and inverted to the front. The sheet P on which the developer images are transferred and thermally fixed is conveyed along the sheet-discharging-side conveyance path 91 by means of the conveyor rollers 92, ejected outside of the main housing 10, and accumulated in the sheet discharging tray 13.

(Charger)

The charger 54 of each process cartridge 50 according to the exemplary embodiment of the invention will now be described.

Figure 3:
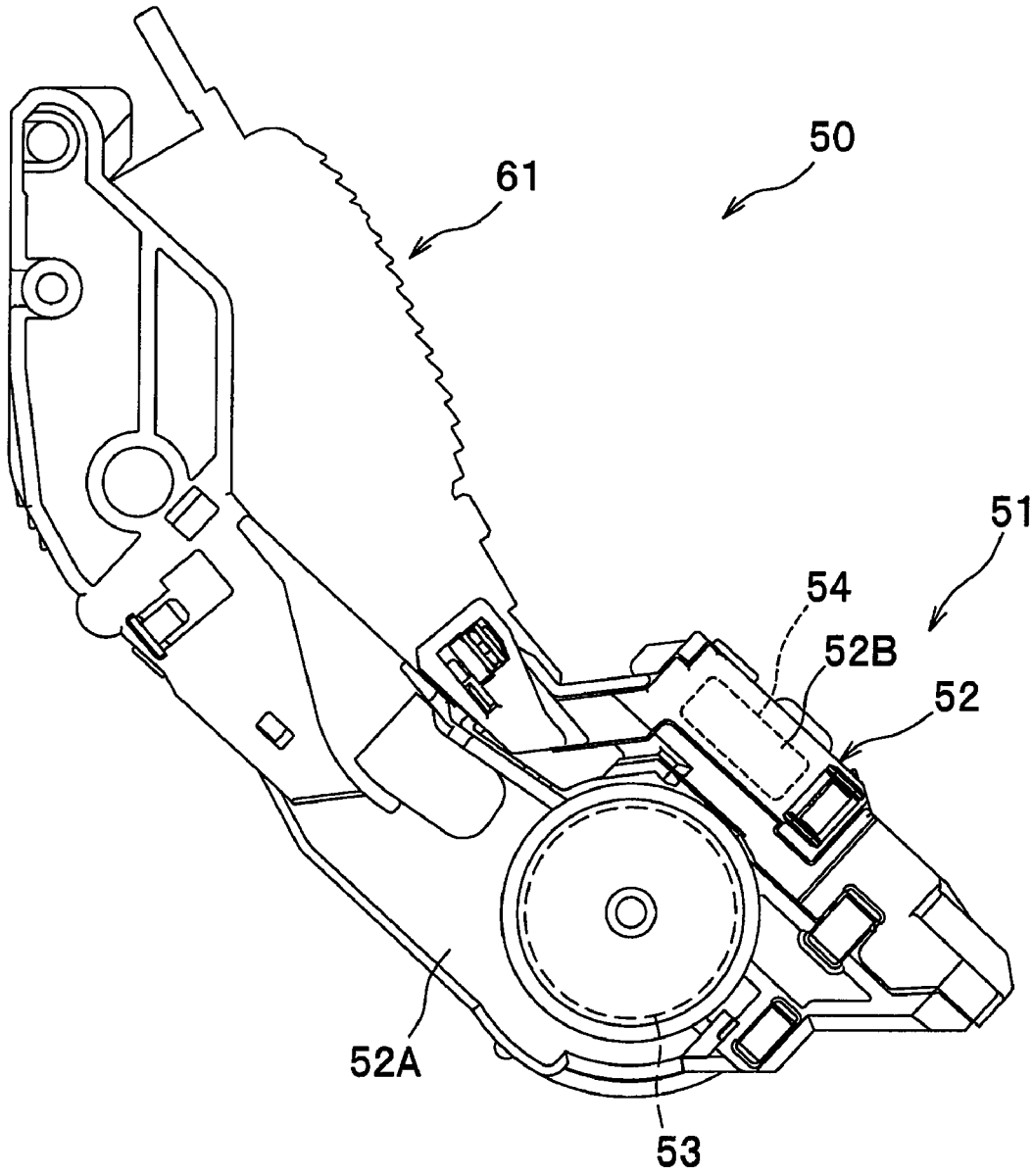
FIG. 3 is a side view of a drum frame and a development unit of the image forming apparatus.

Referring to FIG. 3, each of the process cartridges 50 has the drum unit 51 and the development unit 61. The drum unit 51 has the drum frame 52 that supports the photosensitive drum 53 and the charger 54.

As shown in FIG. 3, the drum frame 52 includes a drum lower frame 52A and a drum upper frame 52B. The drum lower frame 52A supports the photosensitive drum 53, and the development unit 61 is removably attached to the drum lower frame 52A. The drum upper frame 52B supports the charger 54 and is formed from a resin-molded product.

Figures 4A, 4B:
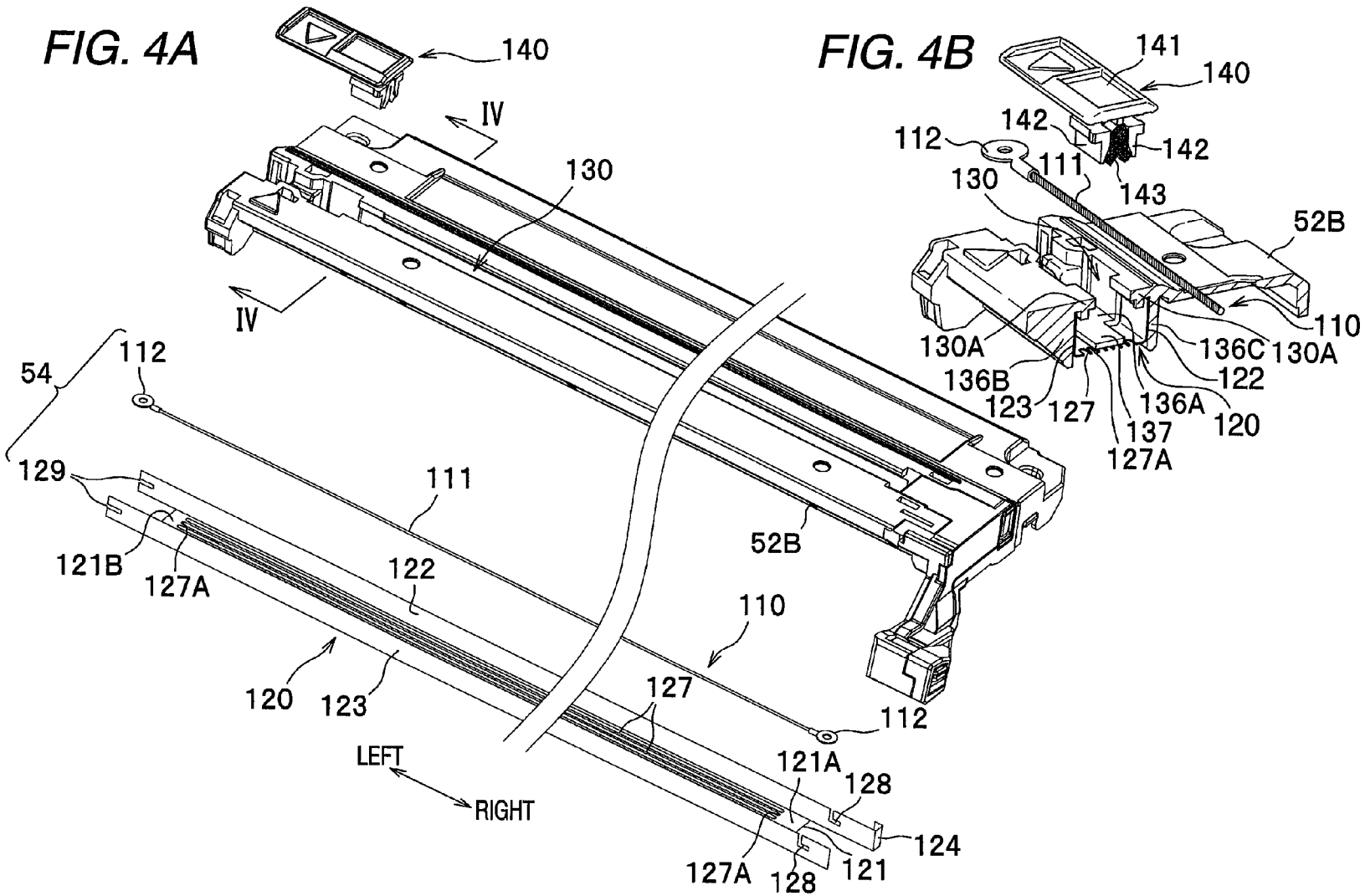

As shown in FIG. 4A, the charger 54 is attached into the drum upper frame 52B. A mount groove 130, to which the charger 54 is to be attached, is formed in the drum upper frame 52B along the longitudinal direction thereof. In FIGS. 4A and 4B, the charger 54 is attached to the drum upper frame from below. A cleaning member 140 for cleaning a wire 111 of a charging wire 110 is attached to the mount groove 130 from above in FIG. 4A. As shown in FIG. 4A, when the cleaning member 140 is located at the left end, there is achieved a housed state of the cleaning member 140, namely, a state where the user has finished cleaning operation and attaches the process cartridge 50 to the main housing 10.

The charger 54 includes a charging wire 110 and a grid electrode 120. The grid electrode 120 is provided between the charging wire 110 and the photosensitive drum 53.

The charging wire 110 has the metal wire 111 and ring hooks 112 attached to both ends of the wire 111. The charging wire 110 is stretched along the horizontal direction of the drum upper frame 52B, in other words, the axial direction of the photosensitive drum 53.

A grid electrode 120 includes a lower plate 121, a front plate 122 and a rear plate 123. The lower plate 212 extends in the horizontal direction, namely, the direction in which the charging wire 110 is stretched. The front plate 122 and the rear plate 123 are continual to lateral ends of the lower plate 121. The grid electrode 120 is formed into a substantially U-shape in a side view.

When attached to the drum upper frame 52B of the grid electrode 120, the lower plate 121 is provided between the photosensitive drum 53 and the charging wire 110 and serves as a section that bears the function of the electrode of the grid electrode 120. In a center portion of the lower plate 121, an opening area OA where a plurality of slit-shaped grid holes 127 are formed (see FIG. 5). A horizontal range of the opening area OA is wider than a range W where an image is formed on the sheet P. Incidentally, some areas where no grid holes 127 are formed are left in ends 121A and 121B of the lower plate 121 achieved in the horizontal direction thereof.

The rear plate 123 is formed so as to extend longer than the lower plate 121 in opposite directions along the horizontal direction. A notch 128 opened in the upward direction of FIG. 4 is formed in a right end of the rear plate 123. The notch 128 extends from up to down in FIG. 4 and then makes a turn toward the right end so as to form a substantially L-shape. A notch 129 opened leftward is formed in a left end of the rear plate 123.

The notches 128 and 129 are formed in the front plate 122, as well as the rear plate 123. The right end of the front plate 122 extends further longer than the right end of the rear plate 123 and is bent twice in a direction opposite to the lower plate 121 (i.e., toward the outside) so as to form a hook-shaped end. The right end face functions as an electric terminal 124.

The notches 128 and 129 are used for engaging the grid electrode 120 with the drum upper frame 52B.

Figure 5:
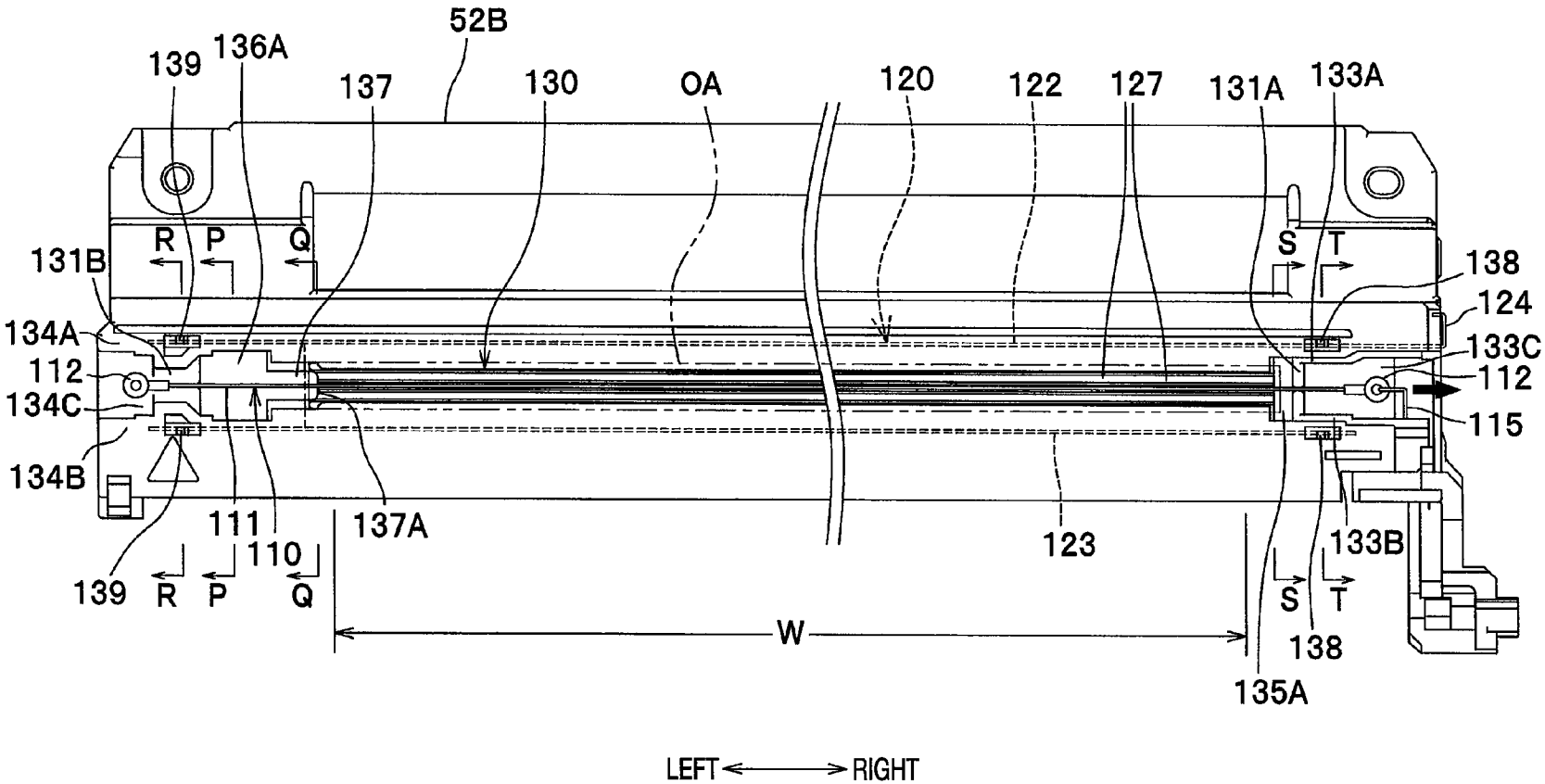
FIG. 5 is a plan view of the drum upper frame.

As shown in FIG. 5, structures for stretching the charging wire 110 are provided outside of the mount hole 130 of the drum upper frame 52B in the horizontal direction. First, an installation section 131B, to which one ring hook 112 of the charging wire 110 is latched and through which the wire 111 is caused to pass, is provided at the left outside of the mount hole 130. One compartment surrounded by a sidewall 134A, a sidewall 134B, and a bottom wall 134C is formed on the left side of the installation section 131B. The ring hook 112 latched to the installation section 131B is surrounded by the respective walls 134A to 134C so as not to directly face the grid electrode 120.

An inner wall 131A having a narrow groove, through which the wire 111 of the charging wire 110 is caused to pass, is provided on the right outside of the mount groove 130. A sidewall 133A, a sidewall 133B, and a bottom wall 133C are provided, on the right outside of the inner wall 131A, so as to be continual to the inner wall 131A. One compartment is formed as being surrounded by the inner wall 131A, the sidewall 133A, the sidewall 133B, and the bottom wall 133C, and the other ring hook 112 is disposed in the compartment. The other ring hook 112 is pulled by one arm of a torque spring 115. A voltage is imparted to the charging wire 110 by way of the torque spring 115 (not illustrated in detail). The right ring hook 112 is also surrounded by the inner wall 131A, the sidewall 133A, the sidewall 133B, and the bottom wall 133C so as not to directly face the grid electrode 120.

Details on the cleaning member 140 are described by reference to FIG. 4B. The cleaning member 140 has an operation section 141 and two pad support sections 142 extending, at both sides of the wire 111, from the operation section 141 toward the grid electrode 120 (i.e., a lower side shown in FIG. 4B). The pad support section 142 functions as an example of a side block wall. A pad 143 that makes a slidable contact with the wire 111 to wipe off dust adhered to the wire 111. A pad 143 is folded into a substantially U-shape and is attached to the pad support section 142. The cleaning member 140 is engaged with an upper marginal area 130A of the mount groove 130 and moves along the marginal area 130A. According thereto, the cleaning member is movable along the wire 111.

Figure 6A:
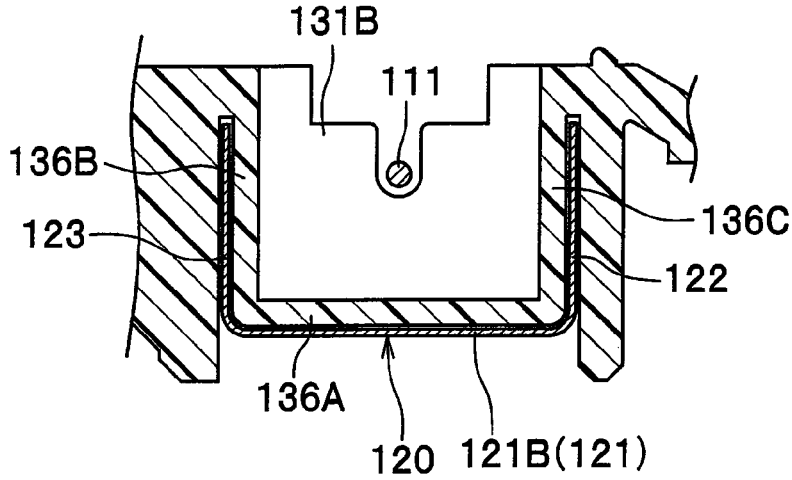

As shown in FIGS. 4A, 4B and 6A, a first left block wall 136A is interposed between the charging wire 110 and the ends 121A and 121B disposed outside of the charging wire 110 of the opening area OA of the grid electrode 120 in the longitudinal direction. The first left block wall 136A prevents the ends 121A and 121B from facing the charging wire 110 in a direction of the shortest distance. The wire 111 is stretched and forms a straight line shape. Therefore, the "direction of the shortest distance to the charging wire 110" is achieved at an arbitrary position on the wire 111 signifies an arbitrary direction perpendicular to the direction in which the wire 111 extends, for example, an arbitrary direction that radially extends from the wire 111 with regard to the cross section thereof in FIG. 6A.

A sidewall 136B and a sidewall 136C are continually provided upright on both sides of the first left block wall 136A. The sidewalls 136B and 136C are disposed inside of the rear plate 123 and the front plate 122 of the grid electrode 120. Therefore, the first left block wall 136A, the sidewall 136B, and the sidewall 136C prevent the grid electrode 120 from not facing the wire 111 in the direction of the shortest distance.

Figure 6B:
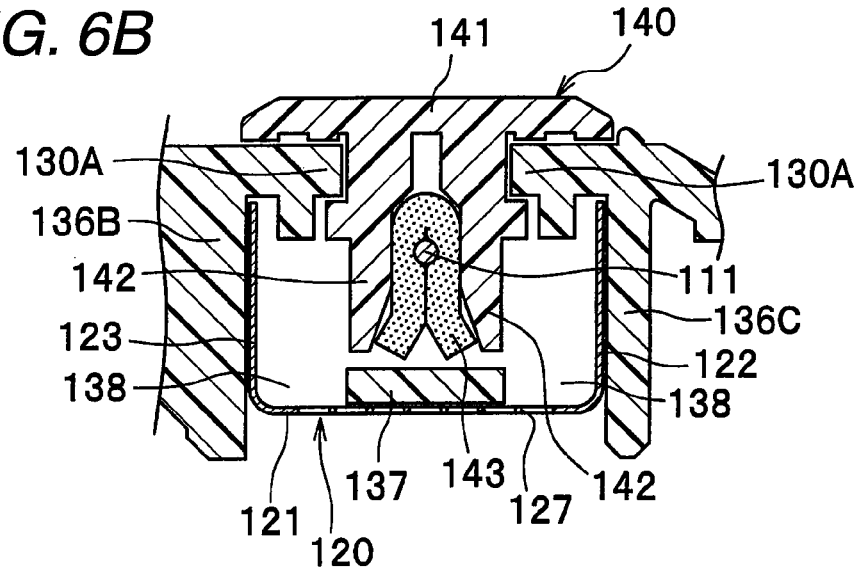

As shown in FIG. 6B, a second left block wall 137 is disposed between the wire 111 and the lower plate 121 of the grid electrode 120 at a position on the drum upper frame 52B facing the cleaning member 140 in a state of being housed. The second left block wall 137 functions as an example of a facing block wall of the block members. As shown in FIG. 4B, the second left block wall 137 is formed by inwardly extending the first left block wall 136A with respect to the horizontal direction. Incidentally, under the constraints in extracting the drum upper frame 52B, the second left block wall 137 is not connected to the sidewalls 136B and 136C, and clearance 138 is formed between the second left block wall 137 and the sidewall 136B and between the second left block wall 137 and the sidewall 136C (see FIG. 6B).

A marginal edge 137A (see FIG. 5) of the second left block wall 137 located inside with respect to the longitudinal direction of the charging wire 110, namely, the horizontal direction, is orthogonal to the longitudinal direction. Therefore, the wire 111 directly faces the opening area OA, at the inside of the marginal areas 137A in the horizontal direction, in the direction of the shortest distance. However, the wire 111 does not directly face the opening area OA at positions outside of the marginal areas 137A. If the marginal areas 137A are oblique with respect to the longitudinal direction of the wire 110, the wire 111 will face the opening area OA only in some directions with regard to a cross section achieved in the vicinity of each of the marginal areas 137A. In such a case, non-uniform corona discharge may be generated. However, in the exemplary embodiment of the invention, the marginal areas 137A are orthogonal to the longitudinal direction of the wire 110. Therefore, non-uniform discharge can be prevented, and uniformity of a corona discharge can be enhanced.

When the cleaning member 140 is in a housed state, the two pad support sections 142 extend to positions close to inner ends of the second left block wall 137 with regard to the horizontal direction. As a result, the second left block wall 137 and the pad support sections 142 form a compartment having a substantially U-shaped cross-sectional shape, although little clearance is present between the second left block wall 137 and the pad support sections 142. The wire 111 is at least prevented from directly facing the lower plate 121 of the grid electrode 120 in the direction of the shortest distance. Specifically, the pad support sections 142 of the cleaning member 140 configure a part of the block member.

Figure 6C:
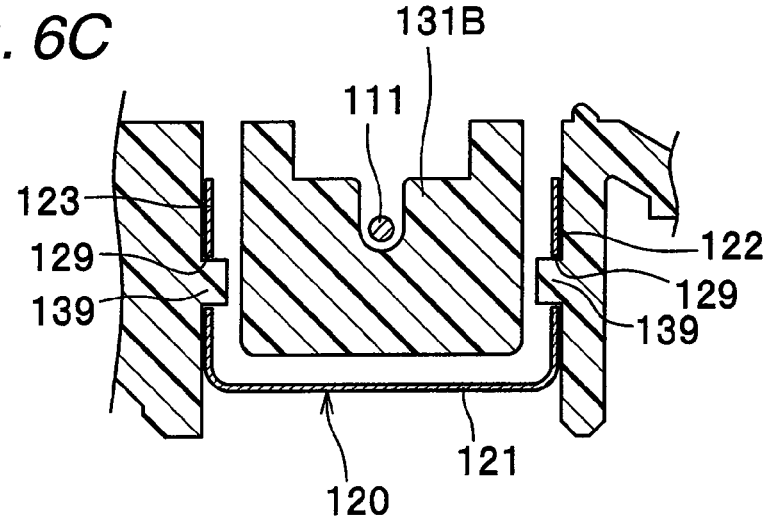

As shown in FIG. 6C, the wire 111 is substantially surrounded by the installation section 131B with respect to the cross section including the left notch 129 and prevented from directly facing the grid electrode 120.

Figure 7A:
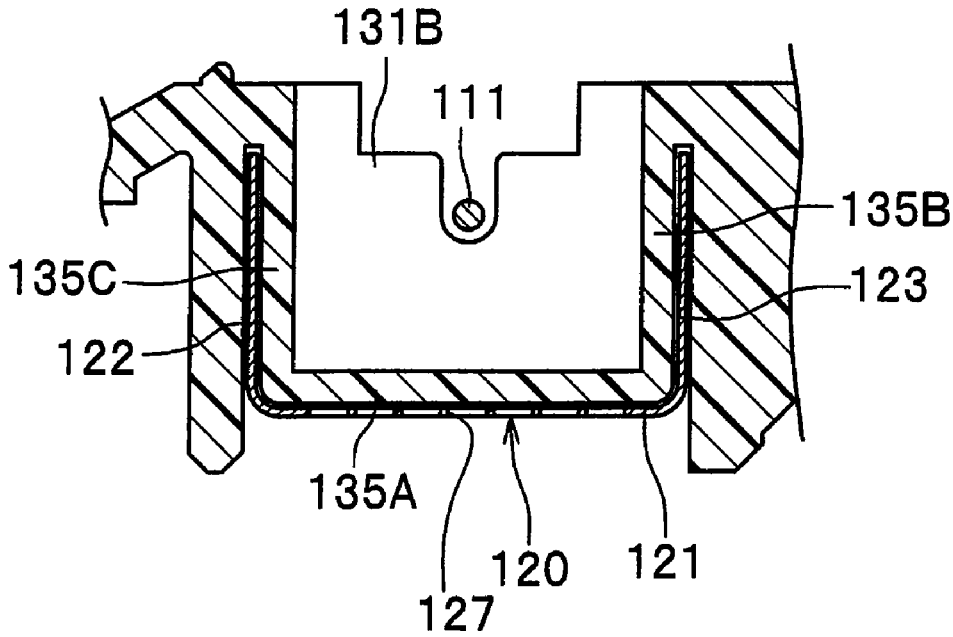

As shown in FIG. 5, a right block wall 135A extending inwardly along the lower plate 121 of the grid electrode 120 is provided at an inner position of the right inner wall 131A with regard to the horizontal direction. As shown in a cross-sectional view provided in FIG. 7A, a sidewall 135B and a sidewall 135C are continually provided upright on both sides of the right block wall 135A. The sidewall 135B is disposed inside the rear plate 123 of the grid electrode 120, and the sidewall 135C is disposed inside the front plate 122 of the grid electrode 120. Therefore, the grid electrode 120 is prevented from facing the wire 111 in the direction of the shortest distance by means of the right block wall 135A, the sidewall 135B, and the sidewall 135C.

Figure 7B:
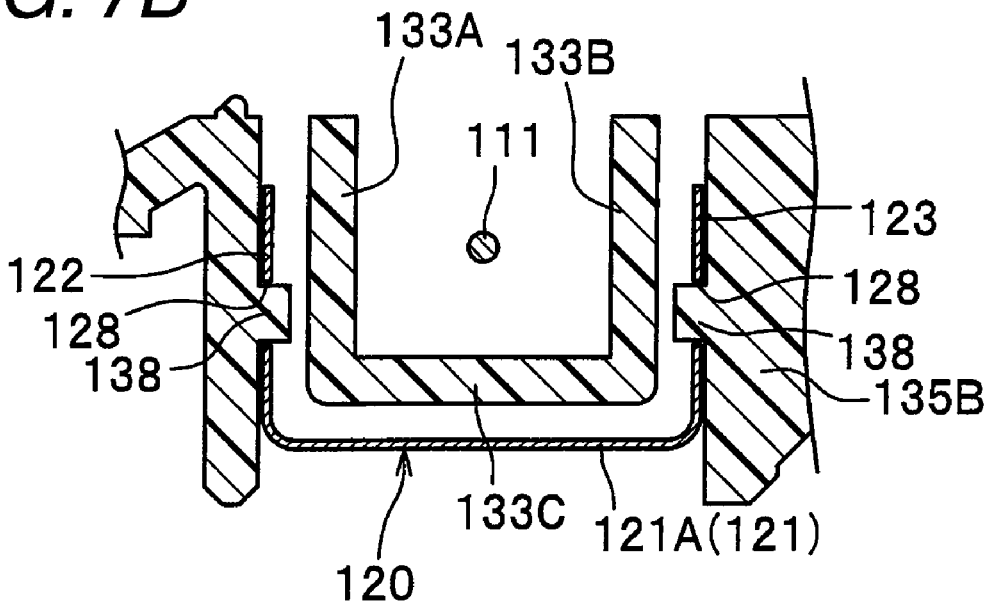

As shown in FIG. 7B, the wire 111 is surrounded by the sidewall 133A, the sidewall 133B, and the bottom wall 133C with respect to the cross section including the right notch 128, thereby being prevented from directly facing the grid electrode 120.

According to the exemplary embodiments of the invention, upon receipt of an instruction of print processing from an external device (i.e., a personal computer), the image forming apparatus 1 feeds the sheet P to the image forming section 30, and the image forming section 30 forms developer images on the respective photosensitive drums 53 by means of the process cartridges 50. At this time, a voltage is applied to each charging wire 110 and each grid electrode 120, and a corona discharge occurs between the charging wire 110 and the grid electrode 120. An ionized air contacts the photosensitive drums 53, so that the photosensitive drums 53 are charged.

In the chargers 54, a voltage that is relatively higher than that applied to the grid electrodes 120 are applied to the charging wires 110, whereby an electric field develops from the charging wires 110 toward the grid electrodes 120. An electric discharge originating from the charging wire 110 toward the grid electrode 120 tends to occur from respective points on the wire 111 toward paths through which electricity passes most easily. For this reason, a discharge is likely to occur from respective points on the wire 111 toward positions close to the grid electrode 120 or positions on the grid electrode 120 where edges are provided.

Respective margins of the grid holes 127 formed in the grid electrode 120 configure edges. However, the edges are locations to which a discharge is apt to occur from the wire 111. Specifically, of the opening area OA of the grid electrode 120, both marginal areas 127A of the charging wire 110 located in a longitudinal direction thereof, namely, the horizontal direction are locations where a change arises in the distribution of the grid holes 127. Further, since the longitudinal ends of the grid holes 127 are arranged at these edges, a discharge is apt to arise. In the exemplary embodiments of the invention, the marginal areas 127A at both ends are blocked by the resin members so as not to face the wire 111 in the direction of the shortest distance. Thus, occurrence of an unwanted electric discharge from these edges can be prevented. Specifically, the left marginal area 127A in FIG. 5 among the marginal areas of the grid holes 127 is blocked by the second left block wall 137 and the pad support section 142 of the cleaning member 140 from facing the wire 111 in the direction of the shortest distance (see FIG. 6B). Further, the right marginal area 127A in FIG. 5 among the marginal areas of the grid holes 127 is blocked by the right block wall 135A from facing the wire 111 in the direction of the shortest distance. Therefore, an electric discharge is less likely to develop from the wire 111 toward the edges (the marginal areas 127A at both ends of the opening area OA) of the grid holes 127 located outside the image formation range W. Accordingly, a corona discharge can be generated uniformly in the longitudinal direction of the charging wire 110.

In the exemplary embodiments, the cleaning member 140 configures a part of the block members when located at the left end of the charging wire 110. Therefore, occurrence of useless electric discharges outside of the image formation area W can be prevented without provision of separate members.

In the exemplary embodiments, the grid electrode 120 has the notches 128 that turn into the foregoing edges. However, as shown in FIG. 7B, the sidewall 133A, the sidewall 133B, and the bottom wall 133C are provided between the wire 111 and the grid electrode 120 in the cross section taken at the position where the notches 128 are present. Therefore, occurrence of an electric discharge between the wire 111 and the notches 128 can be prevented.

Similarly, as shown in FIG. 6C, the wire 111 is surrounded by the installation section 131B even in connection with the notches 129. Therefore, occurrence of an electric discharge between the wire 111 and the notches 129 can be prevented.

Incidentally, in the above-described exemplary embodiments, the notches 128 are provided only outside of the image formation range W. Alternatively, when the notches are provided within the image formation range W, for instance, in the center of the grid electrode 120 in the horizontal direction thereof, the block members may be provided so as to block the notches from facing the wire 111 in the direction of the shortest distance.

The above-described exemplary embodiments have been described in relation to the process cartridges employed in the color printer. Alternatively, the invention may be applied to any kinds of devices, for example, a monochrome laser printer, a copier, and a multi-function device, so long as process cartridges that use chargers utilizing an electric discharge are included.

In the above-described exemplary embodiments, each of the grid holes 127 has an elongated shape that is not interrupted in the longitudinal direction. Alternatively, the grid hole may also be formed so as to be split in numbers in a longitudinal direction.

While the present invention has been shown and described with reference to certain exemplary embodiments thereof, it will be understood by those skilled in the art that various changes in form and details may be made therein without departing from the spirit and scope of the invention as defined by the appended claims. For example, the shape of the photosensitive member is not limited to the shape of a drum.

What is claimed is:

1. A process cartridge comprising:

a photosensitive member;

a charger, which charges the photosensitive member, and which comprises:

a charging wire; and a grid electrode, which is provided between the charging wire and the photosensitive member, and which has an opening area in a surface opposing the photosensitive member;

a frame that supports the photosensitive member and the charger; and a block member, which is provided between the charging wire and an end portion of the grid electrode in a longitudinal direction thereof, and which prevents a marginal area of the grid electrode from facing the charging wire in a direction with a minimum distance therebetween, the marginal area being defined between an end of the grid electrode and an end of the opening area.

2. The process cartridge according to claim 1, further comprising:

a cleaning member, which is movable along the charging wire, and which is contactable with the charging wire, wherein the block member comprises the cleaning member when the cleaning member is positioned at one end of the charging wire.

3. The process cartridge according to claim 2, wherein the cleaning member comprises a side block wall that extends toward the photosensitive member while covering the charging wire, wherein the frame comprises an opposing block wall that is positioned between the charging wire and the grid electrode, and wherein the block member comprises the side block wall and the opposing block wall.

4. The process cartridge according to claim 1, wherein an end face of the marginal area extends in a direction substantially perpendicular to the longitudinal direction.

5. The process cartridge according to claim 1, wherein the block member is provided inside of the grid electrode.

6. The process cartridge according to claim 5, wherein the grid electrode has a substantially U-shaped cross section.

7. The process cartridge according to claim 1, wherein the charging wire comprises a hook at an end thereof, and wherein the block member surrounds the hook so as to prevent the end portion of the grid electrode from facing the hook in a direction with a minimum distance therebetween.

8. The process cartridge according to claim 1, wherein the grid electrode comprises a notch having a substantially L-shape at the end portion thereof.

9. The process cartridge according to claim 1, wherein the grid electrode comprises:

a first notch at a first end portion thereof; and a second notch at a second end portion thereof.

10. The process cartridge according to claim 1, wherein the block member comprises a resin.

* * * * *